US006716040B1

(12) United States Patent
Martin et al.

(10) Patent No.: US 6,716,040 B1
(45) Date of Patent: Apr. 6, 2004

(54) APPARATUS AND METHOD FOR CIRCUIT BOARD GROUND STRAP

(75) Inventors: Galen M. Martin, Camp Hill, PA (US); Michael J. Engler, Kernersville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/329,733

(22) Filed: Dec. 26, 2002

(51) Int. Cl.[7] ..... H01R 13/648

(52) U.S. Cl. ..... 439/95; 439/97; 411/163; 411/164

(58) Field of Search ..... 439/95, 97; 411/163, 411/164

(56) References Cited

U.S. PATENT DOCUMENTS 4,695,105 A * 9/1987 Ney et al. ..... 439/95
4,946,400 A * 8/1990 Kawai et al. ..... 439/79
5,102,350 A * 4/1992 Janota et al. ..... 439/95
5,267,125 A * 11/1993 Liu ..... 439/95
6,024,586 A * 2/2000 Kumagai ..... 439/95

FOREIGN PATENT DOCUMENTS

DE 3436119 A1 * 4/1986 ..... 439/95

* cited by examiner

*Primary Examiner*—Tho D. Ta

(57) ABSTRACT

An article of manufacture, method, and system for communicating with circuit boards, which has a grounding element with first and second portions, and the first portion is a forked member adopted for providing contact to a circuit board, and the second portion is adopted to provide contact to a grounding feature.

16 Claims, 4 Drawing Sheets

APPARATUS AND METHOD FOR CIRCUIT BOARD GROUND STRAP

FIELD OF THE INVENTION

This invention relates generally to grounding and more particularly to grounding components, which create a grounding condition for an electrical apparatus.

BACKGROUND OF THE INVENTION

Grounding is the intentional electrical connection to a reference-conducting plane, which generally consists of a specific array of interconnected electrical conductors referred to as the grounding conductor. Grounding provides a zero point for an electrical conductor system.

Typically, grounding from a printed circuit board (hereinafter "circuit board") to a grounding feature is done by soldering or pressing a pin of a grounding element into a circuit board, and contacting the grounding element to the grounding feature. The pin is pressed or soldered into the circuit board to provide a grounding path from the circuit board, or another electrical element, to the grounding feature. When the circuit board is contained in a plastic housing, the grounding element is also contained, at least partially, inside of the plastic housing.

As a result of being partially contained in a plastic housing, the grounding element must be configured to partially integrate into the plastic housing to contact the circuit board, while maintaining contact with the grounding feature, which is outside of the plastic housing. Due to the configuration of plastic housings it may become cumbersome and unreliable to press fit or solder a pin into a circuit board.

In view of the foregoing, there is a need to have a permanent and reliable grounding path from a circuit board to a grounding feature via a grounding element.

SUMMARY OF THE INVENTION

The present invention provides for articles of manufacture, systems and methods for communicating with at least one circuit board. In one embodiment, there is a grounding element with a first and second portion. In this particular exemplary embodiment, the first portion is configured as a fork to provide for contact to a circuit board, and the second portion is configured to provide contact to a grounding feature. The grounding feature can, among a number of other grounding features, be a vehicle. In this embodiment, the fork has two prongs extending substantially parallel from the second portion, and the fork is configured to engage the top and bottom portion of a circuit board.

In another embodiment, a grounding system utilizes the exemplary grounding element described above. In this particular embodiment, a housing integrates an exemplary fork and a mounting pad extends externally from the housing integrating the second portion.

In yet another embodiment, there is a method for grounding a circuit board contained in a substantially non-metallic housing, with a grounding element.

DETAILED DESCRIPTION

Figure 1:
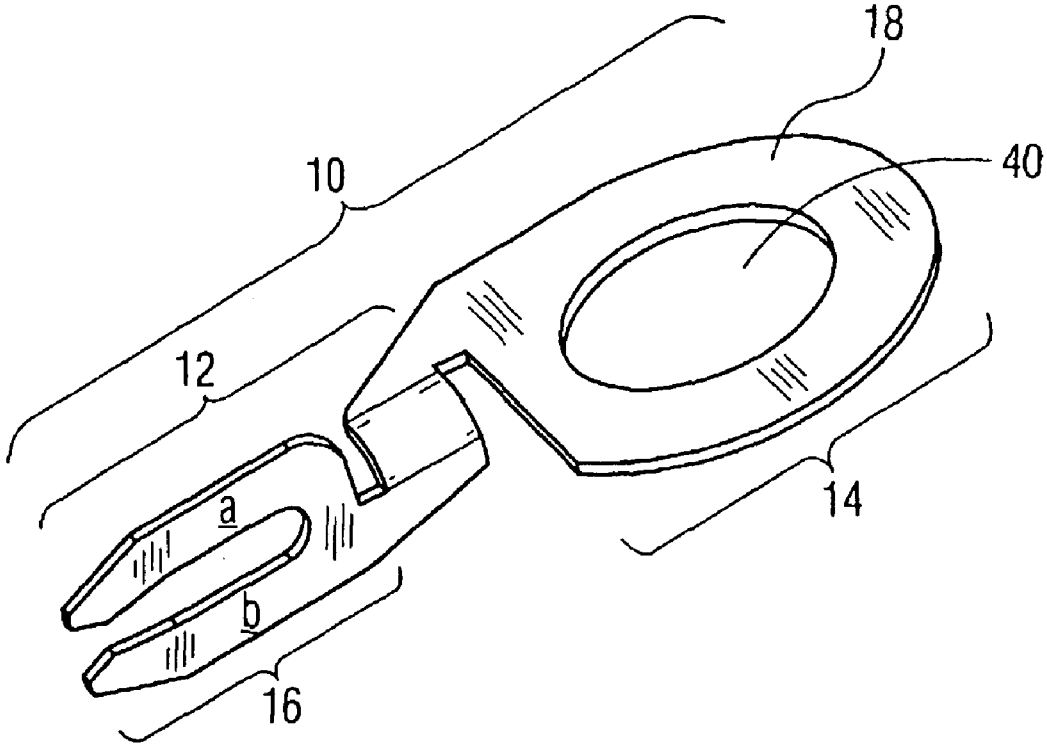
FIG. 1 is a perspective view of a grounding element

While the present invention is susceptible to embodiments in varied forms, what is shown in the drawings will hereinafter be understood to be an embodiment of the present invention. The present disclosure is to be considered as setting forth an exemplification of the invention, which in no way is intended to limit the invention to the specific embodiment illustrated below. In referring to the drawings, like reference numerals indicate like parts throughout the several drawings.

FIG. 1 shows an embodiment of a grounding element 10. In this embodiment the grounding element 10 is comprised of a first portion 12 and second portion 14. In this exemplary embodiment the first portion 12 has a forked member 16. The forked member 16 has two prongs a and b extending substantially parallel to one another from the second portion 14. FIG. 1 further shows an embodiment of the second portion 14 having a substantially annular ring member 18 with an aperture 40.

Figure 2:
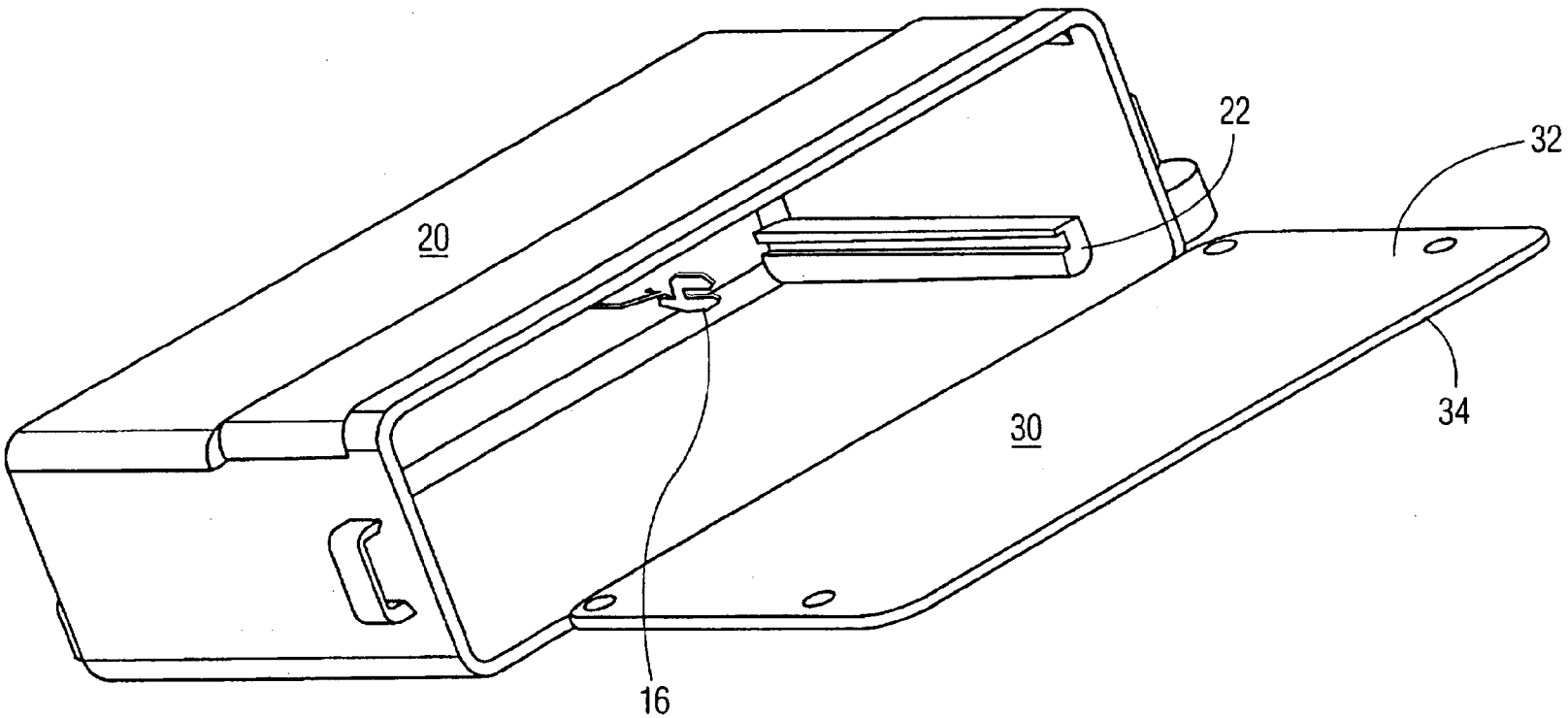
FIG. 2 is a front cross sectional view of a grounding element integrated into a housing, and a circuit board, which can be placed in the housing and contacted to the grounding element

Turning now to FIG. 2, which shows an exemplary embodiment of the grounding element 10 integrated into an exemplary housing 20. In this particular embodiment, the cross sectional view of the housing 20 illustrates one of the two rails 22 contained in the housing 20. The rails 22 act to accept and guide the circuit board 30 into position in the housing 20. FIG. 2 also shows the top portion 32 and the bottom portion 34 of the circuit board 30.

FIG. 2 further shows the integration of the grounding element 10, and more particularly, the integration of the forked member 16 into the housing 20. In this embodiment, the forked member 16, and its two prongs a and b, slide over and contact the top portion 32 and bottom portion 34 of the circuit board 30 when the circuit board 30 is integrated into the housing 20. The forked member 16 provides contact for grounding the circuit board 30 and also helps to physically secure the circuit board 30.

In one embodiment the grounding element 10 is integrated into the housing after the housing is formed, but in another exemplary embodiment, the grounding element 10 is integrated into the housing by insert molding. As a result the grounding element 10 can be introduced into the housing 20 during the formation of the housing 20 or after the housing 20 has already been molded and stamped.

Figure 3:
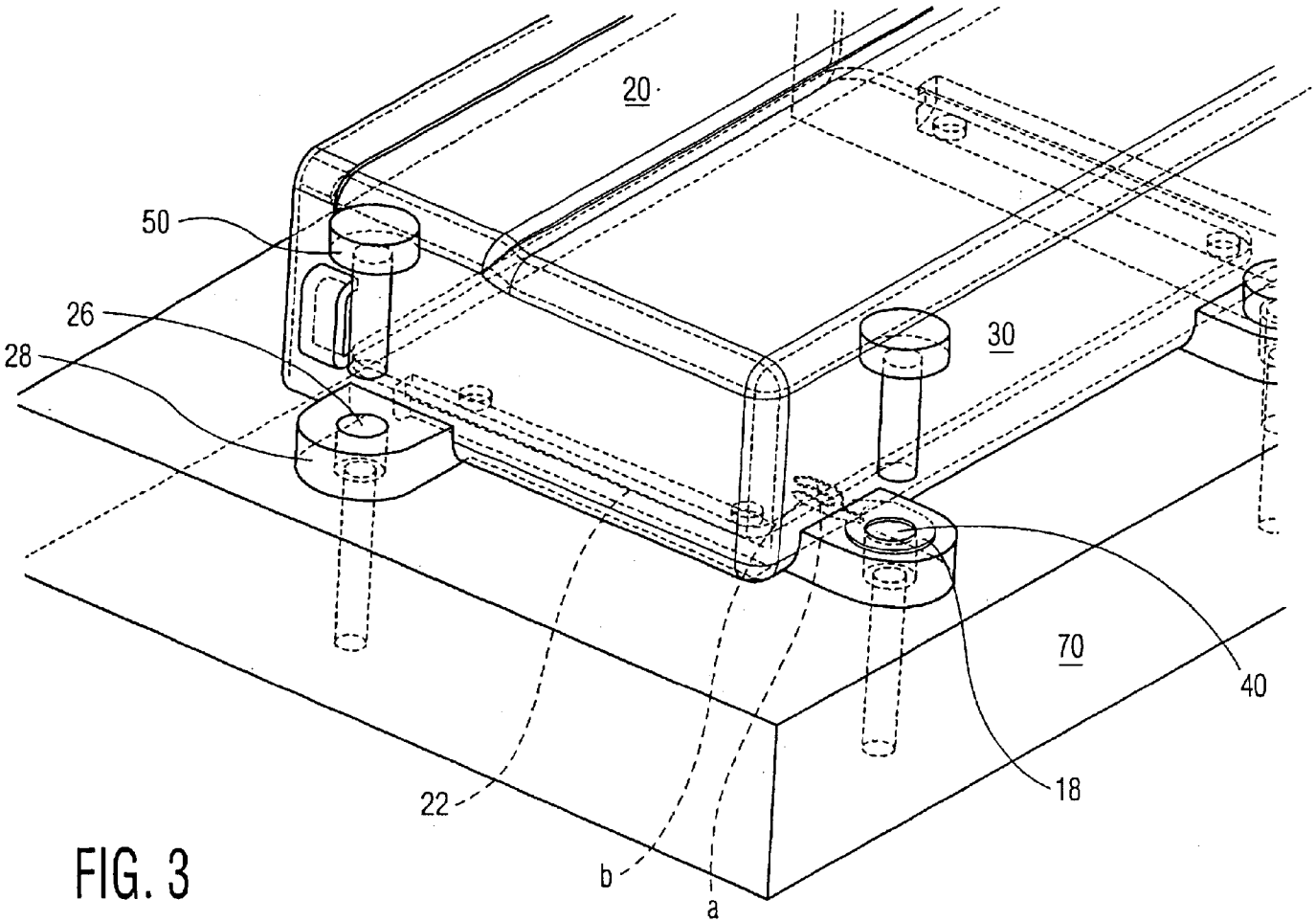
FIG. 3 is a perspective transparent view of a grounding element integrated into a housing and mounting pads.

The embodiment in FIG. 3 shows a semi-transparent perspective view of housing 20 having a grounding element 10 integrated into the housing 20. In this embodiment, the housing 20 has two mounting pads 28 extending there from. The mounting pads 28 are used to secure the housing 20 to a grounding feature 70. In an exemplary embodiment, the grounding feature is a vehicle. The mounting pads 28 have an aperture 26, which allow a clamping member 50 to pass through the aperture 40 of the second portion 14, and then pass through aperture 26 of the mounting pad 28 to secure the housing to the grounding feature 70. The clamping member 50 provides contact from the second portion 14 to the grounding feature 70, thus providing grounding for the circuit board 30 contained within the housing 20. In this particular embodiment, the clamping member 50 comprises a bolt, but in other embodiments the clamping member may comprise other fastening members including, but not limited to, a rivet, a screw, a pin or a press-stud. When the clamping member 50 is fully integrated into the grounding feature 70 a grounding condition is created.

In this exemplary embodiment, the housing 20 is engaged with the grounding feature 70, and wherein the clamping member 50 passes through the aperture 26 of the mounting pads and the aperture 40 of the substantially annular ring member 18 and into the grounding feature 70 securing the housing 20 to the grounding feature 70.

Figure 4:
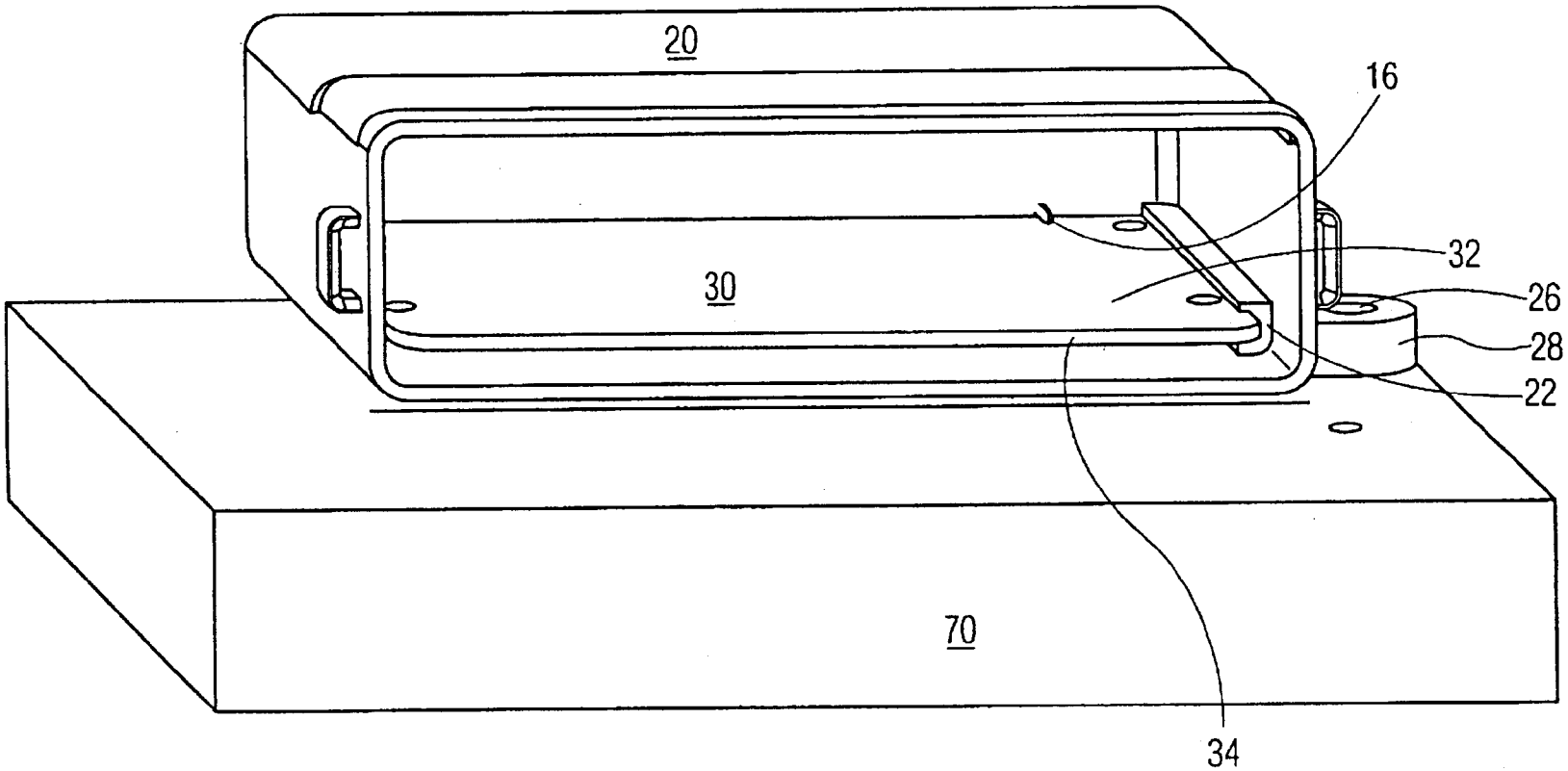
FIG. 4 is a cross sectional view of a circuit board integrated into the exemplary housing of FIGS. 2 and 3 and contacted to a grounding element.

FIG. 4 shows a circuit board 30 integrated into the exemplary housing of FIG. 2. This embodiment shows the two prongs a and b of the forked member 16 contacting the top portion 32 and bottom portion 34 of the circuit board 30. A grounding path travels from the circuit board 30 through the prongs a and b of the forked member 16, and into the second portion 14, which is contacted by clamping member 50. Finally the grounding path travels from the clamping member 50 into the grounding feature 70 to provide grounding for the circuit board 30.

For purposes of this invention, and without limitation, the grounding element 10 and grounding feature 70 described in the present embodiment is preferably comprised of stainless steel, aluminum, titanium, copper, or any other material which is conductive and exhibits appropriate grounding capacity. The housing and grounding feature in the aforementioned embodiments is comprised of a substantially non-conductive material, such as polyethylene, PBT, plastic or Teflon.

The above description and the views and material depicted by the figures are for the purpose of illustration only and are not intended to be, and should not be construed as, limitations on the invention.

Moreover, certain modifications or alterations may suggest themselves to those skilled in the art upon reading of this specification, all of which are intended to be within the spirit and scope of the present invention as defined in the attached claims.

What is claimed is:

1. An article of manufacture for communicating with at least one circuit board comprising:

a grounding element having first and second portions, said first portion comprising a forked member adapted for providing contact to a circuit board, and said second portion being adapted to provide contact to a grounding feature, wherein the forked member includes first and second prongs for holding at least one circuit board therebetween.

2. The article of claim 1, wherein the first and second prongs extend in a direction substantially parallel from the second portion, and wherein said forked member is configured to engage at least a top portion and a bottom portion of the circuit board.

3. The article of claim 1, wherein the second portion is a substantially annular ring member providing clearance for a clamping member.

4. The article of claim 1, wherein said first portion and said second portion are configured to provide communication between the circuit board and the grounding feature.

5. An article of manufacture for communicating with at least one circuit board comprising:

a grounding element having first and second portions, said first portion comprising a forked member adapted for providing contact to a circuit board, and said second portion being adapted to provide contact to a grounding feature;

wherein the article of manufacture is integrated into a substantially non-metallic housing, and wherein the housing further comprises at least one mounting pad having an aperture extending externally thereon, and said housing further comprising rails for sliding the circuit board into the housing.

6. A grounding system for use in a substantially non-metallic housing comprising:

a grounding element having first and second portions, said first portion comprises a forked member providing contact for a circuit board, and said second portion is configured to provide contact to a grounding feature;

a housing having at least one mounting pad extending externally thereon, and having the first portion integrated into the housing and having the second portion integrated into said at least one grounding pad, wherein the forked member includes first and second prongs for holding the circuit board therebetween.

7. The system of claim 6, wherein the first and second prongs extend in a direction substantially parallel from the second portion, and said forked member is configured to engage at least a top portion and a bottom portion of the circuit board.

8. The system of claim 7, wherein the second portion is a substantially annular ring member providing clearance for a clamping member.

9. The system of claim 8, wherein the grounding element is integrated into the housing after the housing is formed.

10. The system of claim 8, wherein the grounding feature is a vehicle.

11. The system of claim 8, wherein the circuit board slides along guide rails of the housing.

12. The system of claim 8, wherein the housing is engaged with the grounding feature, and wherein the clamping member passes through an aperture of said at least one mounting pad and the substantially annular ring member and into the grounding feature securing the housing to the grounding feature.

13. The system of claim 12, wherein said first portion and said second portion provide communication between the circuit board and the grounding feature.

14. A method for grounding a circuit board contained in a substantially non-metallic housing comprising the steps of:

integrating into the housing a grounding element having first and second portions, said first portion comprising a forked member providing contact for a circuit board, said second portion comprises a substantially annular ring member providing clearance for a retaining member; and securing the housing to a grounding feature with the retaining member, wherein said forked member includes first and second prongs for holding the circuit board therebetween.

15. The method of claim 14, wherein the first and second prongs extend in a direction substantially parallel from the second portion, and said forked member is configured to engage at least a top portion and a bottom portion of the circuit board.

16. The method of claim 14, wherein the step of integrating into the housing a grounding element comprises integrating the grounding element into the housing by insert molding.

* * * * *